US009615437B2

(12) United States Patent
Kress

(10) Patent No.: US 9,615,437 B2
(45) Date of Patent: Apr. 4, 2017

(54) APPARATUS AND METHOD FOR OPERATING A LIGHT GENERATOR

(71) Applicant: IIE GMBH & CO. KG, Soyen (DE)

(72) Inventor: Ekkehard Kress, Wasserburg (DE)

(73) Assignee: IIE GmbH & CO. KG, Soyen (DE)

( * ) Notice: Subject to any disclaimer, the term of this patent is extended or adjusted under 35 U.S.C. 154(b) by 0 days.

(21) Appl. No.: 15/123,055

(22) PCT Filed: Apr. 17, 2015

(86) PCT No.: PCT/EP2015/058458
§ 371 (c)(1),
(2) Date: Sep. 1, 2016

(87) PCT Pub. No.: WO2015/158921
PCT Pub. Date: Oct. 22, 2015

(65) Prior Publication Data

US 2016/0374185 A1 Dec. 22, 2016

(30) Foreign Application Priority Data

Apr. 19, 2014 (DE) ..... 10 2014 005 669

(51) Int. Cl.
*H05B 41/36* (2006.01)
*H05B 41/02* (2006.01)
*H05B 33/08* (2006.01)

(52) U.S. Cl.
CPC ..... *H05B 41/36* (2013.01); *H05B 33/0815* (2013.01); *H05B 41/02* (2013.01); *H05B 33/0851* (2013.01)

(58) Field of Classification Search
CPC ..... H05B 33/0815; H05B 33/083; H05B 33/0851; H05B 33/0812; H05B 41/36
USPC .... 315/247, 246, 274–298, 307–326, 209 R, 315/224, 225
See application file for complete search history.

(56) References Cited

U.S. PATENT DOCUMENTS

| | | | |
|---|---|---|---|
| 5,097,181 | A | 3/1992 | Kakitani |
| 5,198,726 | A | 3/1993 | Van Meurs et al. |
| 5,600,211 | A | 2/1997 | Luger |
| 6,060,843 | A | 5/2000 | Primisser et al. |
| 2008/0258648 | A1 | 10/2008 | Bleukx et al. |

FOREIGN PATENT DOCUMENTS

| | | | |
|---|---|---|---|
| EP | 0338109 | A1 | 10/1989 |
| WO | 2005107339 | A1 | 11/2005 |

*Primary Examiner* — Tuyet Vo

(74) *Attorney, Agent, or Firm* — Karl F. Milde, Jr.; Eckert Seamans Cherin & Mellott, LLC

(57) ABSTRACT

An apparatus and method for operating a light generator (2) with a voltage source (4) makes possible a simple and reliable determination of the light generator's condition. The apparatus provides (a) a device (5; 13) for generating a measurement voltage the voltage present at ale light generator (2), (b) device (6, 9) for generating a first and a second comparison voltage, each proportional to the current flowing through the light generator (2), (c) a device (9, 8) for forming a difference voltage from the measurement voltage and one comparison voltage and a summation voltage from the measurement voltage and the other comparison voltage, (d) two capacitive rectifiers (7) for rectifying the difference voltage and the summation voltage, and (e) a controller (3), by which the rectified difference voltage and the rectified summation voltage can be evaluated.

14 Claims, 1 Drawing Sheet

APPARATUS AND METHOD FOR OPERATING A LIGHT GENERATOR

BACKGROUND OF THE INVENTION

The invention relates to a device or a method for operating a generator.

UV generators are often used for quick curing of lacquers and paint. Most often, the UV generators are discharge lamps that emit light primarily in the UV range. The UV generators are operated either in flash mode or continuously.

Control and monitoring of such UV generators are very involved and problematic. To ensure continuous and trouble-free operation of a curing system, one has to determine if the UV generator has been ignited and, if during operation at so point, it has become extinguished. If the performance of the UV generator is to be assessed as well, in particular the UV output, this determination depends to a large extent on the active power. However, depending on the lamp being used, the ballast circuit and the operating frequency, the active power may only be a fraction of the reactive power. This determination is, therefore, very problematic.

SUMMARY OF THE INVENTION

The problem addressed by the invention is to improve a device and a method for operating a light generator of the type described above, such that a simple, reliable and cost-effective determination of the light generator's operating state is made possible.

According to the invention, this objective, as well as other objects which will become apparent from the discussion that follows, are achieved by a device which comprises (a) a device for generating a measurement voltage which is proportional to the voltage applied to the light generator, (b) a device for generating a first and a second reference voltage, which are each proportional to the current flowing through the light generator current, (c) a device to form from the measurement voltage and the one reference voltage a differential voltage and from the measurement voltage and the other reference voltage a sum voltage, (d) two rectifiers for rectifying the differential voltage and the sum voltage, as well as (e) a control that can be used to analyze the rectified differential voltage and the rectified sum voltage are provided for this purpose.

The ratio of sum voltage to differential voltage depends on the phasing of the current and the voltage in the device. For example, the biggest difference between the sum and differential voltage arises when voltage and current are in phase or in phase opposition (with opposite signs). On the other hand, the smallest difference arises at a phase shift of about 250° or about 70°. Thus, a conclusion about the phase shift between the lamp voltage and the lamp current, and thus about the condition of the lamp, can be drawn from the difference between the sum voltage and the differential voltage, as well as the sign thereof.

The rectifiers that are used to rectify the two reference voltages are advantageously designed as AC-coupled rectifiers.

Through the combination according to the invention and the thereby possible comparison of the rectified differential voltage with the rectified sum voltage, it becomes possible to assess the state of the light generator. For this, a calibration must be performed before the operation such that the values of the rectified differential voltage and sum voltage can each be correlated to a state of the light generator (particularly ignited or not ignited).

This calibration can be performed during the production of the device, such that the expensive and complex measurement technology is not required for each device, but only once at the factory where the device according to the invention is manufactured. The device according to the invention can be realized with simple and inexpensive components and works accurately and reliably.

Advantageously, the first and the second reference voltage are of equal value. In this way, not only the reference values can be formed in a particularly simple manner, but it is also possible to draw conclusions about the condition of the capacitors and diodes used in the rectifiers. The rectifiers are advantageously designed as peak rectifiers.

Additional details and advantages of the invention will become apparent from the dependent claims.

Advantageously, the voltage source is electrically isolated from the light generator. In this way, a significantly higher security can be achieved. There is no danger for the operating personnel even at a voltage of about 6 kV.

Preferably, the device operates with an electrically isolated voltage source. In this way, it is very easy to generate a measurement voltage that is proportional to the voltage applied to the light generator. For this purpose, the device for generating a measurement voltage has a measuring coil or a voltage converter transformer at an electrically isolated voltage source. However, it is also possible to provide a voltage divider for direct tapping. The voltage divider may consist of purely resistive or complex resistances. If a separate voltage converter transformer (measuring transformer) is used, it is switched in parallel with the lamp to transform the high voltage to a small measurement voltage. The functions of the measuring winding and the voltage converter transformer are virtually identical.

It is particularly advantageous for the device for generating a first and a second reference voltage to be built as a current measuring converter with two secondary coils. This can generate reference voltages, which are proportional to the current flowing through the light generator, in a particularly simple manner.

The voltage applied to the light generator is easily controllable when voltage pulses are generated. In order to maintain the required voltage, for example, the pulse density or the amplitude of the pulses can be influenced accordingly.

Thus, the voltage source is designed such that it supplies unipolar or bipolar pulses.

A triangle, a trapezoid or a sine may be used as the pulse shape. However, the pulses of the voltage source are particularly advantageously formed as rectangular pulses. A cost-effective, simple ballast can be realized in this way.

As has already been mentioned above, gas discharge lamps are often used as light generators for curing lacquers and paint. However, these lamps can generate only a certain portion of the emitted light in the UV range making its efficiency not optimal. The light generator is therefore advantageously designed such that it generates the light via a dielectric barrier discharge (DBD). A homogeneous discharge can be generated very effectively using pulsed excitation. Another advantage of a light generator DBD is that no metallic electrodes need to be used in the discharge space, thus causing no metallic impurities. There is also no electrode wear. DBD light generators can operate with high efficiency because no charge carriers need to exit or enter at the electrodes.

The difference between reactive power and active power is very large, particularly in a DBD light generator (depending on the design, the reactive power can reach about nine times the amount of the active power). But since the assessment of whether a light generator is in the ignited or the non-ignited state can be detected best by the rapid rise or drop of the active power, it is here that much more important that this is easily possible with the device according to the invention via the values of the rectified sum and differential voltage.

The light generator is particularly advantageously configured as an excimer lamp. Excimer lamps can be designed specifically for the required wavelength via the composition of the used gas.

The method according to the invention is comprised of the following steps: Generating a measurement voltage that is proportional to the voltage applied to the light generator, generating a first and a second reference voltage each of which is proportional to the current flowing through the light generator, generating both a differential voltage from the measurement voltage and the one of the reference voltages, as well as a sum voltage from the measurement voltage and the other reference voltage, rectifying the differential voltage and the sum voltage, and comparing the rectified differential voltage and the sum voltage to calibrated values stored in memory or to calculated values.

Some conclusions can be drawn about the state of the system from the rectified differential and sum voltages, for example about the state of the rectifiers. The phase shift between the lamp current and the lamp voltage also arises from the rectified sum voltage and the rectified differential voltage.

Particularly advantageously, a factor is calculated from the rectified differential voltage and the rectified sum voltage by quotient formation and the state of the light generator is determined through the comparison of the factor with a predetermined threshold. It does not matter whether this differential voltage is divided by the sum voltage or the sum voltage by the differential voltage. The threshold can be set in a calibration, in which a determination is made at which factor the light generator is at an ignited state and at which factor in a non-ignited state.

Because the factors for the ignited and the non-ignited state differ recognizably with correct dimensioning of the device, using the calculated factors allows for relatively clear recognition if the light generator is in an ignited state. By saving the threshold in the control, a direct comparison with the currently determined factor is possible. The ability to recognize the state of the light generator is essential if, for example, a gentle ignition is to be carried out with a minimum ignition voltage. However, this recognition is also required for the early detection of light generator breakdowns. Production errors can be avoided almost entirely in this manner.

A calibration with a power analyzer must be carried out to set an active power with the device. For the calibration, the voltage generated by the voltage source is advantageously associated with the measured values for the active power. Particularly advantageously, a look-up table (LUT) is set up for this purpose. The LUT contains the respective value for the active power measured during calibration and for the respective voltage generated by the voltage source. For monitoring tasks, the respective rectified sum voltage and differential voltage, the factor determined therefrom and the status of the light generator (not ignited or ignited) present under these conditions can be written into the LUT as well. The desired active power can thus be generated directly after the calibration of the system by using the generation of the respective associated voltage via the voltage source.

For example, the calibration can be carried out in the establishment where the device is produced. The values determined for the active power and the respective voltage generated for it via the voltage source are—as described above—saved in a memory as a two-dimensional LUT or an arithmetic approach is determined and stored.

In this way, a voltage to be generated by the voltage source can be assigned to each desired active power via the LUT during operation of the device or can be calculated accordingly. This allows for very simple control adaptable to the requirements.

Typically, the light generator must be ignited with an ignition voltage that is higher than the normal operating voltage. However, ignition should take place at an ignition voltage that is as low as possible to protect the components used and thus to ensure a long service life of the device. It is thus particularly advantageous to carry out the following steps: Carrying out an ignition procedure for the light generator with a low ignition voltage, determining the values of the rectified differential and sum voltages and determining the state of the light generator based on these values, if a non-ignited state is detected, repeating the ignition procedure and re-determining the state of the light generator with a respective increased ignition voltage until an ignited state of the light generator is determined and generating an alarm or error message when a predetermined maximum ignition voltage is reached. The ramp-up of the system can be largely automated in this way. Likewise, a defective goods production can be prevented if the light generator is not ignited.

However, a malfunction can also occur after ignition during operation of the light generator usually at the light generator) that leads to an extinction of the light generator. This condition can be noticed immediately via the determined factor. Therefore, according to the invention, an alarm or an error message is generated if during operation of the ignited light generator values are determined for the rectified differential and sum voltage that correspond to a non-ignited light generator. In this way, malfunctions can be detected and corrected quickly. This can securely avoid prolonged operation of the defective system and a large defective goods production.

For a full understanding of the present invention, reference should now be made to the following detailed description of the preferred embodiments of the invention as illustrated in the accompanying drawings.

DESCRIPTION OF THE PREFERRED EMBODIMENTS

Figure 1:
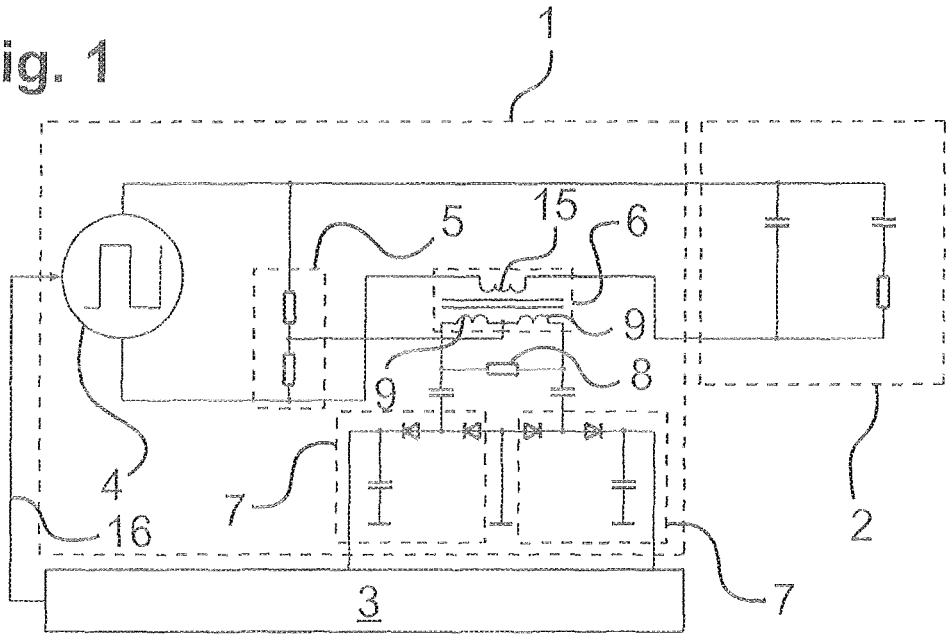
FIG. 1 is a circuit diagram for a first preferred embodiment of the device according to the invention.

The preferred embodiments of the present invention will now be described with reference to FIGS. 1 and 2 of the drawings. Identical elements in the figures are designated with the same reference numerals.

In the preferred embodiment according to FIG. 1, a power source 4, a voltage divider 5, a current measurement converter 6 and two rectifiers 7 are primarily arranged on the power supply 1. The power supply 1 is connected to the lamp 2 and the control 3 via electrical connectors.

The voltage source 4 is formed as a square-wave generator and supplies a bipolar rectangular voltage. It would also be possible to use a unipolar rectangular voltage, or a sine wave voltage or a saw-tooth voltage (each unipolar or bipolar), however, a bipolar square-wave generator has the best price-performance ratio. The voltage of the voltage source 4 is applied directly to the lamp 2.

The voltage divider 5 is used to generate a measurement voltage that is proportional to the voltage applied to the lamp 2. The voltage divider circuit ensures that the measurement voltage changes according to the voltage applied to the lamp 2. Consequently, the measurement voltage provides a signal from which the voltage applied to the lamp 2 could be determined.

A current measuring converter 6 is switched into the circuit between the voltage source 4 and the lamp 2. The primary coil 15 of the current measurement converter 6 is connected in series to the lamp 2 on the power supply 1 of the lamp 2. Electrically isolated from the primary coil 15, the current measurement converter 6 has two secondary coils 9 connected in series. Ideally, the two secondary coils have the same inductance. The signal of the measurement voltage is supplied between the two secondary coils 9.

A voltage, which is composed of the measurement voltage and a voltage that is proportional to the current flowing through the lamp 2, is now applied to both sides of the measuring resistor 8. This voltage is added to the measurement voltage on the one side and subtracted from the measurement voltage on the other side, whereby the respective addition or subtraction result depends on the phase shift between the lamp current and voltage.

The sum and the differential voltage are each applied to peak rectifiers 7 of the same design, each having a capacitor and two diodes. The thus-rectified signals are then supplied for further treatment to the control 3.

For the calibration, the device is advantageously operated with a lamp replacement circuit, a so-called dummy, consisting of two capacitors connected in parallel and a resistor connected in series to one of the capacitors. The lamp 2 is shown accordingly in the drawing. For this purpose, the resistor and the capacitors are set in the dummy such that the electrical characteristics on average correspond to the characteristics of several measured ignited lamps. The calibration is advantageously carried out at the factory because expensive measuring equipment, in particular a power analyzer for measuring the active power, is required for this.

Now, a voltage based on experience is generated via the voltage source 4, which would normally initiate the ignition of the lamp 2. The active power is determined at the dummy via the power analyzer not shown here, and the rectified sum and differential voltages are measured. All values are entered into an LUT.

The same procedure is repeated for different voltages generated via the voltage source 4. The generated voltages should be in a reasonable range. This range extends in the lower region across a voltage with which operation of the lamp is just no longer possible (lower limit of the range) up to a voltage that can still be used to ignite the lamp without damaging the lamp (upper limit of the range).

The measurements generated at different voltages are repeated, wherein the value of the resistance of the dummy is raised so far that the characteristics of the dummy correspond to those of a non-ignited lamp. Here too, the generated voltages should be in a reasonable range. Advantageously, this range is identical to the range used for the calibration of the ignited lamp. At the end of the measurements, a plurality of value groups is available, wherein each of the value groups can be associated with a specific generated voltage at an ignited and/or at a non-ignited lamp.

Now a factor can be associated with each group of values and can be formed mathematically by dividing the sum and differential voltages. This factor is a measure of the phase shift between the lamp current and the lamp voltage. This allows for a good indication whether the lamp is ignited or not.

Each group of values now contains the generated voltage, the measured value for the active power, the rectified sum voltage and differential voltage, and the quotient calculated from sum and differential voltages as a factor. However, the state of the lamp, i.e., ignited or non-ignited can be stored as well. Consequently, an active power is associated with each generated voltage. This device LUT is stored in the control 3. Instead of storing the factors with each group of values, a threshold value can be determined from the factors and stored.

Since a dummy, whose characteristics correspond to the mean characteristics of the lamp types to be used, is used for measuring the power supply 1, a voltage generated by the voltage source 4 will result in a slightly different active power for each lamp. Accordingly, in order to be able to establish an accurate relationship between the generated voltage and the active power, an offset is determined for each lamp at a given generated voltage and an active power measured with a power analyzer. The offset is obtained from the value of the actually generated voltage and the value of the generated voltage in the group of values in which the active power corresponds to the active power measured with the lamp. This offset determined via the measurement can be linked with the lamp in any desired way. For example, a data carrier can be added to the lamp or a code is added that can be used to obtain the respective offset via the Internet.

After installing a new lamp, the offset can then be recalculated with the value of the voltage generated in each group of values of the device LUT. In this manner, an LUT is obtained that correlates to a certain lamp. This adjusted LUT is also stored in the control 3.

However, such an adjusted LUT can also be generated mathematically. For this purpose, a voltage is generated, by which the lamp 2 is in an ignited state. Now, the group of values will be determined in the device LUT in which the values of the sum and of the differential voltage correspond to the measured values. No adjustment needs to be made if the value of the generated voltage in this group of values is identical to the actually generated voltage. However, if there is a resultant deviation, this deviation, in turn, corresponds to the offset, which will need to be recalculated each value for the applied voltage in each group of values.

The lamps 2 used are subject to aging. Consequently, their properties change. As a result, a higher voltage must be generated by the voltage source 4 after a certain number of hours of operation in order to achieve the same UV output. Consequently, a higher active power is required to achieve the same UV output. This effect should be taken into account in the control of the device as well.

To this end, an aging curve could be measured, for example. In this case, a lamp is operated in the device and the UV output is maintained via a respective adjustment of the generated voltage and thus of the active power during the service life of the lamp. In this way, an offset for the generated voltage is obtained for each quantity of operating hours. Since most of the time a counter for the hours of operation is provided in each device, a respective aging LUT can be stored additionally in the control 3. When a quantity of operating hours is reached, the offset can be calculated from the aging LUT with the value of the generated voltage in each group of values.

However, it is also possible to take into account the aging without obtaining an aging LUT. A mathematical adjustment of the adjusted LUT is carried out always after a number of operating hours to be determined beforehand, as described already above for the generation of the adjusted LUT. The time interval between the adjustments does not always have to be of the same duration, rather it should be based on the actual course of aging of the lamp type. This can be done based on measurements or on previous experience.

Of course, arithmetic functions can be stored in place of LUTs. However, most of the time the effort to generate such a function will be too much. Also, the computational effort during the operation may require a computer capacity that can no longer be covered by a microcontroller. Naturally, this may change in future microcontrollers, so that this approach can be a real option in the future.

So far it has been assumed that a particular active power is coupled to a voltage to be generated by the voltage source 4. Of course, the active power can be influenced also by the frequency or by the voltage and frequency together. For reasons of clarity, only a control via the voltage generated by the voltage source 4 shall be covered here.

During operation of the power supply, the control 3 can already derive certain conclusions (e.g., about the condition of the lamp 2) from the factor, i.e., from a quotient that is formed from the absolute values of the two rectified signals of the sum and of the differential voltage. Thus, for example, in case of an in-phase condition of lamp current and lamp voltage and at a shift of 180°, the difference between the sum and the differential voltage is largest, while at a phase shift of 250° or 70°, the difference is smallest. Based on the relationship between sum and differential voltage, i.e., based on the determined factor, it can at least be determined in which of the four quadrants (0-90°; 90-180°; 180-270°; 270-360°) the phase shift between lamp current and lamp voltage is located. A conclusion about the state of the lamp can be drawn already from the determined phase shift.

An accurate assessment if the lamp 2 is ignited can be carried out if a limit value is formed from the determined factors stored in the device LUT. Since the factors are very different in the ignited and non-ignited state, such that a correlation to the respective lamp state is readily possible, a limit value can be set as a respective mean value. This limit value is also stored in the control 3. Naturally, when determining a factor, the group of values or the groups of values in which the determined factor is contained can be determined as an alternative. If the state of the lamp is also recorded in every group of values, a determination can be made directly from the LUT whether the lamp is in an ignited or non-ignited state.

When switching on the device, a first ignition attempt is started with a voltage that is at the lower limit of the ignition voltage. After a period that is usually sufficient for the ignition of the lamp 2, a check will be carried out if the lamp 2 has in fact ignited. For this purpose, the control 3 determines the factor and compares it with the factor stored as a limit value or the factors stored in the LUT. This allows for a fairly unambiguous determination of the state of the lamp 2.

If it is determined that the lamp 2 is not ignited, a second ignition attempt is made, in which the ignition voltage is increased by a reasonable amount, for example by 10%. After the period that is usually sufficient for the ignition of the lamp 2, another check will be carried out based on the factor if the lamp 2 is ignited. If this is again not the case, the next ignition will be attempted. The ignition attempts will continue until an upper limit value of the ignition voltage is reached. If at that point still no ignition can be determined, an error is present and a visible and/or an audible alarm are generated that informs the operating personnel about the error.

During the next start-up of the device, the initial ignition attempt will advantageously not start at the lowest possible ignition voltage. The ignition voltage for the initial ignition attempt is determined by taking multiple parameters into account. For example, the value at which the ignition was successful at the last start-up, the time since the last operation and/or the temperature and lighting conditions may be taken into account. To this end, the successful ignition voltage and, for example, the turn-off time are stored in the control 3 and the last stored values are overwritten at every start-up.

Since the voltage supply 1, but in particular the isolation of possibly used transformers ages faster by applying very high voltages, the service life can be extended by this ignition method. Furthermore, using this ignition test can prevent that the production starts potentially with a non-ignited lamp entailing a possible defective goods production and thus a high reject rate.

The ignited lamp shall be operated at a certain active power. For this purpose, the control 3 determines in the adjusted LUT that the group of values in which the active power corresponds to the desired value. From the determined group of values, it retrieves the value of the voltage that must be generated by the voltage source 4 to achieve the desired active power. The control 3 appropriately controls the voltage source 4 via the connecting line 16 and in doing so reduces the voltage applied to the lamp 2 from the ignition voltage to the appropriate operating voltage.

It can also be determined via the factor if the lamp 2 extinguishes suddenly during operation after successful ignition. If this error were to remain undetected, a large number of rejects would be produced. Since an alarm is triggered immediately in this case as well, production can be stopped immediately and the damage can be corrected.

Figure 2:
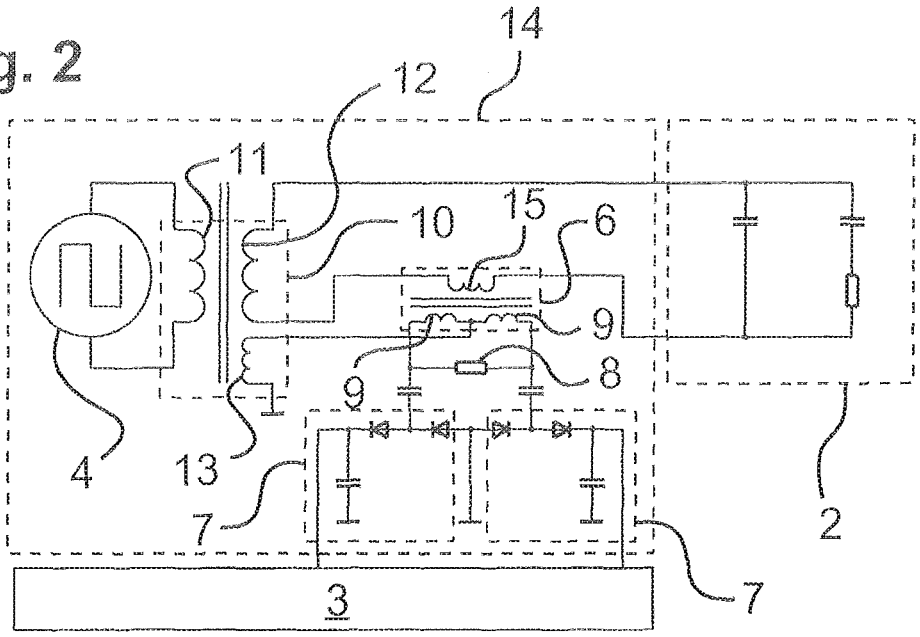
FIG. 2 is a circuit diagram for a second preferred embodiment of the device according to the invention.

The exemplary embodiment of FIG. 2 differs from the exemplary embodiment of FIG. 1 primarily through the voltage supply and the generation of the measurement voltage. FIG. 2 uses the same reference characters as FIG. 1 for the same components.

Here, the voltage source 4 is electrically isolated from the actual power supply and the lamp 2 via the transformer 10. The voltage source 4 is connected to the primary winding 11 of the transformer 10. The current measurement converter 6 and the lamp 2 connected in series therewith are, however, supplied via the secondary winding 12 of the transformer 10. Furthermore, a measuring coil 13 is provided in the transformer 10 on the secondary side as a second winding. The measurement voltage is generated via this measuring winding 13 and is supplied to the current measurement converter 6 between the two secondary coils 9. This measurement voltage too is proportional to the voltage that is applied to the lamp 2.

By using the transformer 10, the power supply 14 of the second preferred embodiment is somewhat more complex and more expensive to manufacture than the power supply 1 of the first exemplary embodiment. However, the transformer has the advantage that substantially higher voltages can be generated for operating the lamp 2, thus making wattages of several kilowatts possible. Thus, a higher production speed and savings in production costs for the products to be dried are achieved naturally.

There has thus been shown and described a novel apparatus and method for operating alight generator which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

The invention claimed is:

1. A device for operating a light generator with a voltage source comprising, in combination:

(a) a device for generating a measurement voltage that is proportional to the voltage applied to the light generator, (b) a device for generating a first and a second reference voltage that are each proportional to the current flowing through the light generator, (c) a device for forming a differential voltage from the measurement voltage and the one reference voltage and a sum voltage from the measurement voltage and the other reference voltage, (d) two rectifiers for rectifying the differential voltage and the sum voltage, and (e) a control for evaluating the rectified differential voltage and the rectified sum voltage.

2. The device as in claim 1, wherein the device for generating a first and a second reference voltage includes a current measurement converter with two secondary coils.

3. The device as in claim 1, wherein the device for generating a measurement voltage includes a voltage divider for directly tapping a voltage.

4. The device as in claim 1, wherein the voltage source is electrically isolated from the light generator.

5. The device as in claim 4, wherein the device for generating a measurement voltage has one of a measurement winding and a voltage converter transformer at the electrically isolated voltage source.

6. The device as in claim 1, wherein the voltage source is designed such that it supplies unipolar or bipolar pulses.

7. The device as in claim 6, wherein the pulses of the voltage source are structured as right-angle pulses.

8. The device as in claim 1, wherein the light generator generates the light via a dielectric barrier discharge.

9. The device as in claim 8, wherein the light generator comprises an excimer lamp.

10. A method for operating a light generator with a voltage source, said method comprising the steps of:

(a) generating a measurement voltage that is proportional to the voltage applied to the light generator, (b) generating a first and a second reference voltage that is each proportional to the current flowing through the light generator, (c) generating a differential voltage from the measurement voltage and said first reference voltage, and generating a sum voltage from the measurement voltage and said second reference voltage, (d) rectifying the differential voltage and the sum voltage, and (e) comparing the rectified differential and sum voltages to calibrated values stored in a memory or to calculated values.

11. The method as in claim 10, further comprising the step of calculating a factor from the rectified differential voltage and the rectified sum voltage by quotient formation, and determining a state of the light generator by comparing said factor with a predetermined threshold.

12. The method as in claim 10, further comprising comparing a voltage generated by a voltage source with measured values for the active power for the purpose of calibration.

13. Method as in claim 10, further comprising the following steps:

(f) carrying out an ignition procedure for the light generator with a low ignition voltage, (g) determining values for the rectified differential voltage and sum voltage, and determining the state of the light generator based on these values, (h) upon detection of a non-ignited state, repeating the ignition procedure and determining the state of the light generator with a respective increased ignition voltage until an ignited state of the light generator is determined, and (i) generating an alarm or an error message when a predetermined maximum ignition voltage is reached.

14. The method as in claim 10, further comprising generating an alarm or an error message if, during operation of the ignited light generator, values are determined for the rectified differential voltage and the sum voltage that correspond to the rectified differential voltage and the sum voltage, respectively, of a non-ignited light generator.

* * * * *